US011122911B2

(12) United States Patent
Dorfman et al.

(10) Patent No.: US 11,122,911 B2
(45) Date of Patent: Sep. 21, 2021

(54) MODULAR SLEEP SOLUTION

(71) Applicants: Audrey Dorfman, San Francisco, CA (US); Michelle Muhme, San Francisco, CA (US)

(72) Inventors: Audrey Dorfman, San Francisco, CA (US); Michelle Muhme, San Francisco, CA (US)

( * ) Notice: Subject to any disclaimer, the term of this patent is extended or adjusted under 35 U.S.C. 154(b) by 269 days.

(21) Appl. No.: 15/851,034

(22) Filed: Dec. 21, 2017

(65) Prior Publication Data

US 2018/0168362 A1 Jun. 21, 2018

Related U.S. Application Data

(60) Provisional application No. 62/437,621, filed on Dec. 21, 2016.

(51) Int. Cl.

| | |
|---|---|
| ***A47C 27/14*** | (2006.01) |
| ***A47C 31/12*** | (2006.01) |
| ***A47C 27/00*** | (2006.01) |
| ***A47C 27/12*** | (2006.01) |
| ***A47C 21/04*** | (2006.01) |

(Continued)

(52) U.S. Cl.

CPC ..... *A47C 27/146* (2013.01); *A47C 21/006* (2013.01); *A47C 21/046* (2013.01); *A47C 21/048* (2013.01); *A47C 27/001* (2013.01); *A47C 27/08* (2013.01); *A47C 27/12* (2013.01); *A47C 27/121* (2013.01); *A47C 27/124* (2013.01); *A47C 27/148* (2013.01); *A47C 31/123* (2013.01); *A47C 27/002* (2013.01); *A61H 2201/0146* (2013.01)

(58) Field of Classification Search

CPC ... A47C 27/121; A47C 27/001; A47C 27/146; A47C 27/08; A47C 21/006; A47C 21/046; A47C 27/124; A47C 21/048; A47C 27/12; A47C 27/148; A47C 31/123; A47C 27/002; A47C 27/15; A47C 31/105; A61H 2201/0146; A47G 9/0246

USPC ..... 5/485

See application file for complete search history.

(56) References Cited

U.S. PATENT DOCUMENTS

| | | | |
|---|---|---|---|
| 252,973 | A | 1/1882 | Shenk |
| 1,002,006 | A | 8/1911 | Stapely |

(Continued)

FOREIGN PATENT DOCUMENTS

DE 3147023 A1 * 6/1983 ..... A47G 9/0207

OTHER PUBLICATIONS

The Thread Exchange, "Nylon Thread Information", Aug. 21, 2013, pp. 1 and 2 (Year: 2013).*

*Primary Examiner* — Nicholas F Polito
*Assistant Examiner* — Luke Hall
(74) *Attorney, Agent, or Firm* — Perkins Coie LLP

(57) ABSTRACT

A modular sleep apparatus that enables customization of a conventional mattress. The modular sleep apparatus includes a customizable mattress pad casing having pockets into which various inserts can be placed. The more the number of pockets, the greater customization the mattress pad allows. The inserts themselves can be of varying thickness, firmness, and material. The inserts can also be placed directly over a conventional mattress and held in place with a fitted sheet. The inserts can also be placed directly into pockets or envelopes in the top layer of a mattress. The mattress pad casing can be pre-assembled with inserts.

18 Claims, 10 Drawing Sheets

(51) Int. Cl.
*A47C 21/00* (2006.01)
*A47C 27/08* (2006.01)

(56) References Cited

U.S. PATENT DOCUMENTS 1,148,584 A * 8/1915 Gerrish ..... B29C 66/1142 156/258
1,540,685 A * 6/1925 Eiband ..... A47C 27/002 5/657
1,566,354 A * 12/1925 Suekoff ..... A47C 27/002 5/655.8
1,575,813 A * 3/1926 Burke ..... A43B 13/383 12/145
1,883,837 A * 10/1932 Wallace ..... A47C 21/022 5/248
2,103,553 A * 12/1937 Reynolds ..... A47C 21/046 5/652.1
2,162,021 A * 6/1939 Kidwell ..... A47C 21/048 5/694
2,177,679 A * 10/1939 Weisbender ..... A47G 9/0207 5/485
2,237,892 A * 4/1941 Squire ..... A43B 17/00 36/43
2,369,531 A * 2/1945 Caltabiano ..... A43B 13/16 36/31
2,462,780 A * 2/1949 Schiller ..... A47G 9/02 5/485
2,651,788 A 9/1953 Forwood
3,148,387 A 9/1964 Sarnie, Jr. et al.
3,191,197 A 6/1965 Frey
3,210,781 A * 10/1965 Pollock ..... A47C 27/001 5/718
3,419,920 A 1/1969 Maddux, Jr. et al.
3,521,311 A 7/1970 Cohen
3,742,528 A 7/1973 Muench
3,775,785 A * 12/1973 Mittendorf ..... A47G 9/10 5/640
3,868,735 A * 3/1975 Ross ..... A47G 9/0246 5/497
3,952,429 A * 4/1976 Thomas ..... A43B 13/16 36/31
4,005,499 A * 2/1977 Klein ..... A47G 9/023 5/485
4,136,685 A * 1/1979 Ramey ..... 5/915
4,213,214 A * 7/1980 Gilhooly ..... A47C 27/001 5/679
4,231,125 A * 11/1980 Tittl ..... A47G 9/062 5/419
4,256,096 A 3/1981 Budde
4,388,738 A * 6/1983 Wagner ..... A47C 31/105 5/421
4,608,768 A * 9/1986 Cavanagh ..... A43B 13/181 36/28
4,624,061 A * 11/1986 Wezel ..... A43B 5/06 36/102
4,737,998 A 4/1988 Johnson, Sr.
4,777,678 A * 10/1988 Moore ..... A47C 17/045 5/632
4,839,934 A * 6/1989 Rojas ..... A47G 9/0207 5/485
4,872,228 A 10/1989 Bishop
4,873,734 A * 10/1989 Pollard ..... A47C 21/08 5/425
4,876,755 A 10/1989 Parrish
4,947,500 A * 8/1990 Seiler ..... A47C 27/081 5/706
4,970,743 A 11/1990 Wride et al.
4,998,311 A * 3/1991 Ernst ..... A47C 7/021 297/228.1
5,099,530 A * 3/1992 Scott ..... A47G 9/02 5/419
5,163,195 A * 11/1992 Hill ..... A47G 9/10 5/637
5,182,825 A 2/1993 Stinson et al.
5,231,717 A 8/1993 Scott et al.
5,247,714 A 9/1993 Lipps
5,299,335 A * 4/1994 Ivester ..... A47C 27/001 128/202.18
5,421,045 A * 6/1995 Bowen ..... A47G 9/0207 446/73
5,438,719 A * 8/1995 Anthony ..... A47G 9/02 5/485
5,457,829 A * 10/1995 Elliott ..... A47G 9/0207 5/420
5,629,071 A * 5/1997 Feldman ..... A45C 3/10 383/4
5,671,492 A * 9/1997 Simon ..... A47C 27/144 5/722
5,701,620 A 12/1997 Montross
5,701,623 A * 12/1997 May ..... A47C 27/15 5/739
5,737,785 A * 4/1998 Casey ..... A45F 4/02 5/417
D407,191 S * 3/1999 McKenzie, Jr. ..... D2/952
5,953,779 A * 9/1999 Schwartz ..... A47C 27/001 5/692
5,991,946 A * 11/1999 Harris ..... A47G 9/0246 5/485
6,085,373 A * 7/2000 Montana ..... A47C 27/001 5/722
6,088,858 A 7/2000 Juster et al.
6,142,963 A * 11/2000 Black ..... A61H 23/0254 601/57
6,182,314 B1 * 2/2001 Frydman ..... A47C 20/021 128/845
6,237,171 B1 * 5/2001 Allen ..... A47G 9/0207 5/482
6,243,896 B1 * 6/2001 Osuna ..... A47G 9/0261 5/502
6,286,166 B1 9/2001 Henley et al.
6,345,401 B1 * 2/2002 Frydman ..... A47G 9/10 5/636
6,481,033 B2 11/2002 Fogel
6,647,570 B1 * 11/2003 Ong ..... A47G 9/02 5/417
6,681,422 B2 * 1/2004 Landry ..... A47D 15/008 128/872
6,687,935 B2 2/2004 Reeder et al.
6,739,001 B2 5/2004 Flick et al.
6,859,961 B1 3/2005 Barr
6,990,701 B1 1/2006 Litvak
7,013,512 B1 * 3/2006 Hsu ..... A47G 9/1081 5/636
7,174,585 B1 * 2/2007 Sorrentino ..... A47G 9/062 5/417
7,191,483 B2 3/2007 Hochschild
7,210,250 B2 * 5/2007 Gallegos ..... A43B 1/0054 36/140
7,971,292 B1 * 7/2011 Sithian ..... A47C 20/021 5/485
8,046,852 B1 * 11/2011 Hoo ..... A47G 9/0246 5/485
8,215,037 B2 * 7/2012 James ..... A43B 1/0072 36/103
8,230,619 B2 * 7/2012 Salvatelli ..... A43B 7/1465 36/88
8,832,889 B2 * 9/2014 Sportis ..... A47C 27/148 5/727
8,978,275 B2 * 3/2015 James ..... A43B 13/188 36/103
8,984,690 B2 3/2015 Chunglo
9,060,618 B2 * 6/2015 Sommer ..... A47C 21/08
9,089,230 B2 * 7/2015 Cho ..... A61F 5/01
9,295,599 B2 * 3/2016 Dyevich ..... A61G 7/05715
2004/0168257 A1 9/2004 Torrez
2006/0112491 A1 * 6/2006 Buehner ..... A47G 9/0238 5/691
2007/0251016 A1 * 11/2007 Feher ..... A47C 7/748 5/713

(56) References Cited

U.S. PATENT DOCUMENTS

| | | | | |
|---|---|---|---|---|
| 2007/0271817 | A1* | 11/2007 | Ellis, III | A43B 7/144 36/28 |
| 2007/0289069 | A1 | 12/2007 | Wells | |
| 2008/0127414 | A1* | 6/2008 | Allen | A47G 9/062 5/417 |
| 2008/0141458 | A1* | 6/2008 | Prater | A47G 9/068 5/484 |
| 2009/0000031 | A1* | 1/2009 | Feher | A47C 7/748 5/423 |
| 2009/0056017 | A1* | 3/2009 | Jones | A47G 9/02 5/485 |
| 2009/0070941 | A1 | 3/2009 | Lau | |
| 2010/0024127 | A1 | 2/2010 | Schantz | |
| 2013/0014328 | A1* | 1/2013 | Requet | A47G 9/109 5/640 |
| 2013/0263377 | A1* | 10/2013 | Wootten, Jr. | A47C 27/15 5/640 |
| 2013/0305619 | A1* | 11/2013 | Turcot | E04H 15/20 52/2.13 |
| 2014/0283305 | A1* | 9/2014 | Zysman | A47C 27/142 5/636 |
| 2014/0366269 | A1* | 12/2014 | Brensinger | A47G 9/086 5/413 R |
| 2016/0201351 | A1* | 7/2016 | Pirkle | E04H 15/20 135/121 |
| 2016/0227938 | A1 | 8/2016 | Pennington et al. | |
| 2016/0324329 | A1 | 11/2016 | Costantino, III et al. | |
| 2017/0035211 | A1* | 2/2017 | Alletto, Jr. | A47C 27/062 |

* cited by examiner

MODULAR SLEEP SOLUTION

CROSS REFERENCE TO RELATED APPLICATIONS

This application claims priority to U.S. provisional patent application Ser. No. 62/437,621, filed Dec. 21, 2016, which is incorporated herein in its entirety by this reference thereto.

RELATED FIELD

Various embodiments relate generally to sleep apparatuses. More specifically, various embodiments relate to a modular sleep solution that offers an affordable and adaptable customized bedding solution.

BACKGROUND

When two users share a mattress, their comfort preferences and needs often diverge. One user might prefer a soft mattress; the other might prefer a firm mattress. Even with a single user, his or her preferences may change daily. For instance, after a particularly strenuous workout, the user might desire more support from a particular area of the mattress but may prefer a soft mattress on an average night. Consumers want a way to meet their evolving needs, but because of the high cost of mattresses, they are reluctant to replace them frequently.

Consumers who want area-specific customization of their mattresses must purchase an adjustable mattress that costs thousands of dollars. While consumers can use commercially available and affordable mattress pads to customize their mattresses, these pads are of uniform thickness and material across the entire bed, and do not allow for individualized customization of different areas of the mattress.

The Sleep Number® bed is one of the most well-known customizable mattresses available on the market. It is priced well into the thousands, but its customization options are limited to adjusting the firmness of the mattress. Moreover, the Sleep Number® mattress has mechanical and electric parts, which makes it susceptible to breakdowns and malfunctions. Another shortcoming of this mattress is that it requires a platform base and cannot be used with the most common slatted and box spring bases. Other adjustable beds and mattresses available today have similar deficiencies. While mattress pads can be used to alter and customize mattresses, are affordable, do not have mechanical parts, and can be used with any bed and mattress, they do not allow customization to the same extent as adjustable beds. They also do not allow for customization of different areas of the mattress.

SUMMARY

Embodiments of the invention concern a modular sleep solution with inserts suitable for placement on top of a conventional mattress. The modular sleep solution may include a customizable mattress pad casing having pockets into which various inserts may be placed. The more the number of pockets, the greater customization the mattress pad allows. The inserts themselves can be of varying thickness, firmness, and material. In a second embodiment, the inserts may also be placed directly over a conventional mattress and held in place with the help of a fitted sheet. A third option is for the inserts to be inserted directly into pockets or envelopes in the top layer of a mattress.

In some embodiments, the customizable mattress pad entirely envelopes all sides of the mattress, except for the bottom. The customizable mattress pad may be made from any material suitable for bedding, e.g. cotton, wool. In some embodiments, the upper surface of the mattress pad that comes in contact with the bedsheet may be made of a waterproof material. The customizable mattress pad may have four corners and either two or four sides fitted with elastic to keep it from slipping from its position over the mattress and so that it may be stretched taut over the mattress. In some embodiments, the mattress pad sits only on top of the mattress.

DETAILED DESCRIPTION

Figure 1:
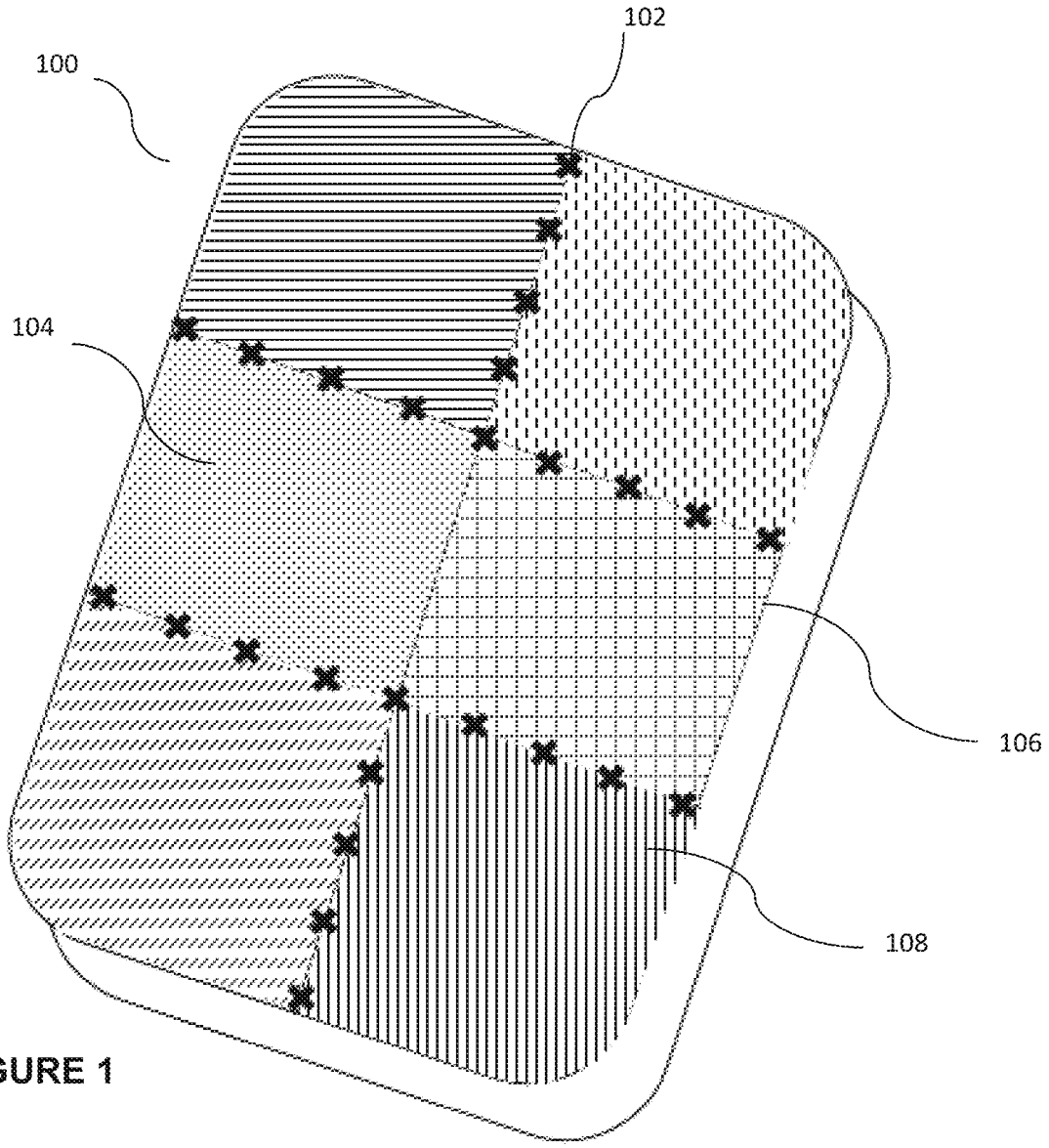
FIG. 1 shows the modular sleep system inserts placed directly over a conventional mattress and held in place by a fastening mechanism.

FIG. 1 shows the modular sleep solution 100 with inserts 104 and 108 placed over a conventional mattress 106. The inserts may be held in place using an unobtrusive mechanism 102 such as snaps, buttons, hook and loop fasteners such as those produced by Velcro®, etc. The inserts 104 and 108 themselves are filled with different materials, e.g. down filling for softness, coir or latex for more firm support, a cooling gel, such as a phase-change material, to keep the user cool on warm nights. In one embodiment, the inserts are inflatable. The inflatable inserts are fitted with a one-way air valve such that air can easily enter the insert but not leave it. Before being placed on the mattress, the inserts are inflated according to the user's preferences. An almost full inflatable insert provides firm support, whereas a less full insert provides softer support. The inserts may also be inflated manually by the user before or after they are placed onto a mattress using a remote controlled or automatic inflator.

Figure 2:
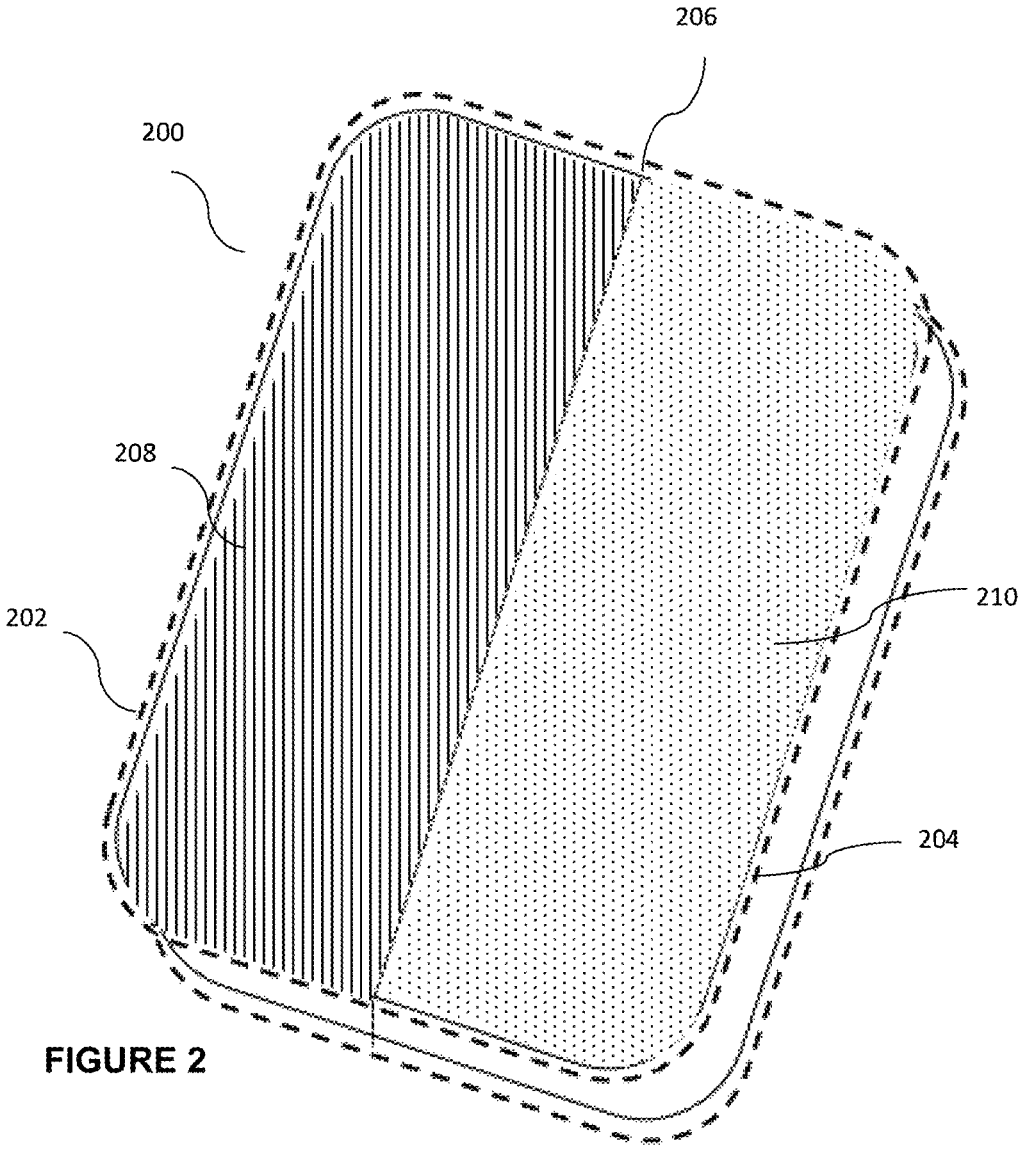
FIG. 2 shows the mattress pad of the invention with two pre-assembled customized pad areas, fitted over a conventional mattress.

FIG. 2 shows a customizable mattress pad 200 fitted over and around a conventional mattress. In the embodiment shown in FIG. 2, a customizable mattress pad 200 includes two inserts 208 and 210 placed in pockets 202 and 204 separated by a seam 206. The customizable mattress pad 200 may be pre-assembled with a set of inserts selected by the user. The seam 206 may therefore be made of reinforced stitching using an upholstery thread made of, for instance, bonded nylon or bonded polyester. In some embodiments, the inserts 208 and 210 have interlocking shapes to keep them from shifting so not to require an inner seam to separate the pockets. The inserts 208 and 210 are represented by different patterns in FIG. 2 to allow the reader to distinguish between the two inserts, but can appear the same in practice. In some embodiments, the mattress casing is pre-assembled to hold only one insert along one side of the bed so that the other side does not add any padding to the mattress.

Figure 3:
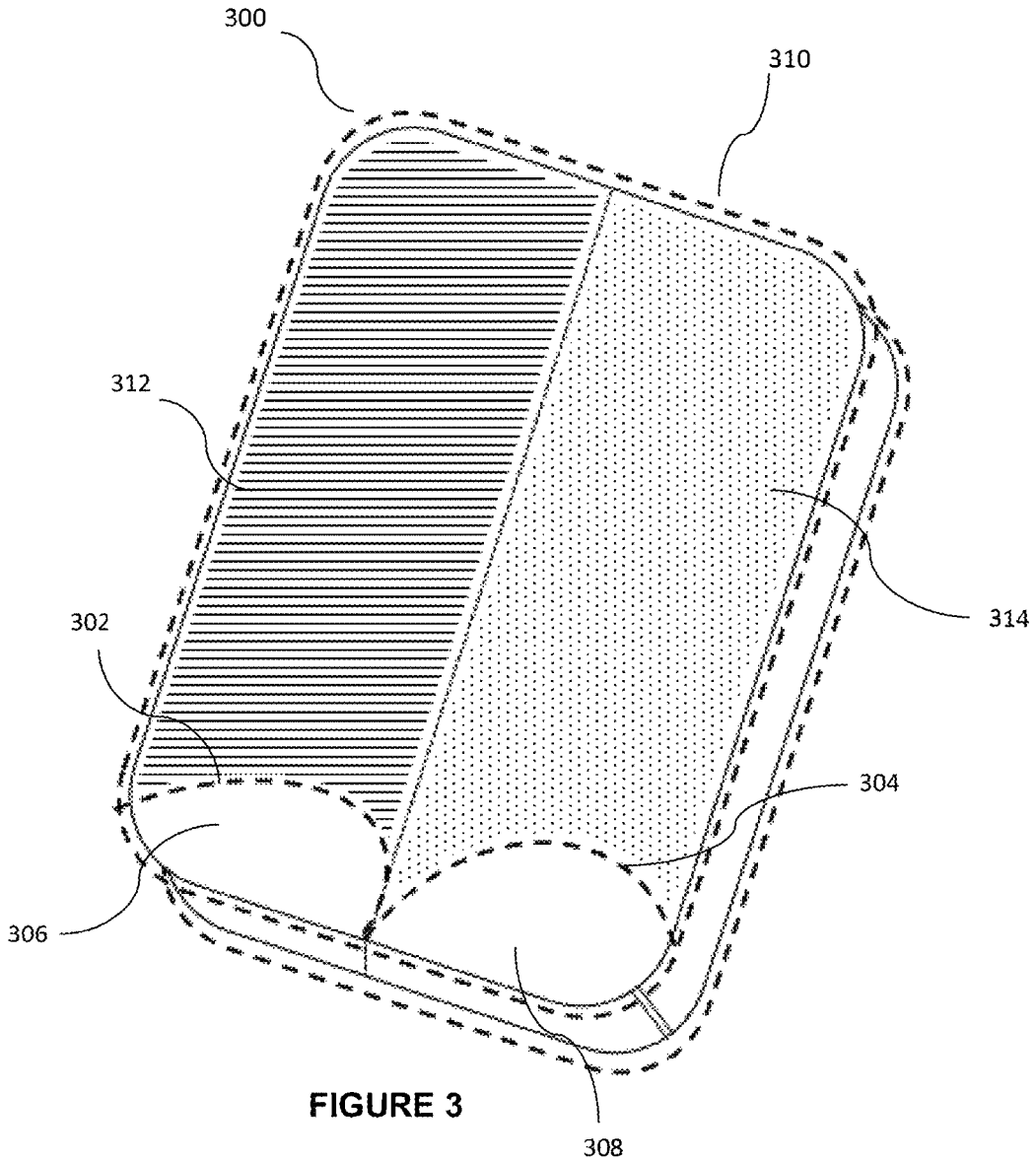
FIG. 3 shows the customizable mattress pad of the invention with two customizable areas where inserts may be placed, with openings positioned at the bottom end of the mattress.

FIG. 3 shows one embodiment of a customizable mattress pad 300 fitted over and around a mattress, with two pockets 302 and 304. The pockets 302 and 304 have openings near the bottom edge of the mattress in the form of slits 306 and 308. The pockets are separated by seam 310, similar to the seam 206 in FIG. 2. A user can place inserts 312 and 314 into the pockets through the slits 306 and 308. The pockets may have openings to sides, the top, or the bottom of the customizable mattress pad. The inserts 312 and 314 themselves are filled with different materials, e.g. down filling for softness, coir or latex for more firm support, a cooling gel, such as a phase-change material, to keep the user cool on warm nights. In one embodiment, the inserts are inflatable. The inflatable inserts are fitted with a one-way air valve such that air can easily enter the insert but not leave it. Before being placed in the customizable mattress pad casing, the inserts are inflated according to the user's preferences. An almost full inflatable insert provides firm support, whereas a less full insert provides softer support. The inserts may be inflated manually by the user before they are placed into the customizable mattress pad 300, or after, using a remote controlled or automatic inflator. In another embodiment, the inserts include a motor for introducing vibrations. A user may use vibrating inserts for relieving muscle aches or for relaxation. The casing covering the inner filling of the insert may be made of a material similar to the material of the customizable mattress pad 300, e.g. cotton, wool. Once the inserts 312 and 314 are placed inside the pockets 302 and 304, the pockets may be temporarily sealed using closure mechanisms, e.g. buttons, zippers, hooks Velcro®.

The customizable mattress pad also allows for certain pockets to remain empty while insert pads are placed in other pockets. For instance, when two users are sharing a mattress, one user might want an insert pad placed in the customizable mattress pad casing, while the other user might prefer the mattress as is. The inserts themselves sit sandwiched between two layers of the customizable mattress pad casing 300. As explained in FIG. 3, each insert may be filled with one of several different materials. The top layer of the customizable mattress pad is in contact with a bedsheet and the bottom layer is in contact with a mattress.

Figure 4:
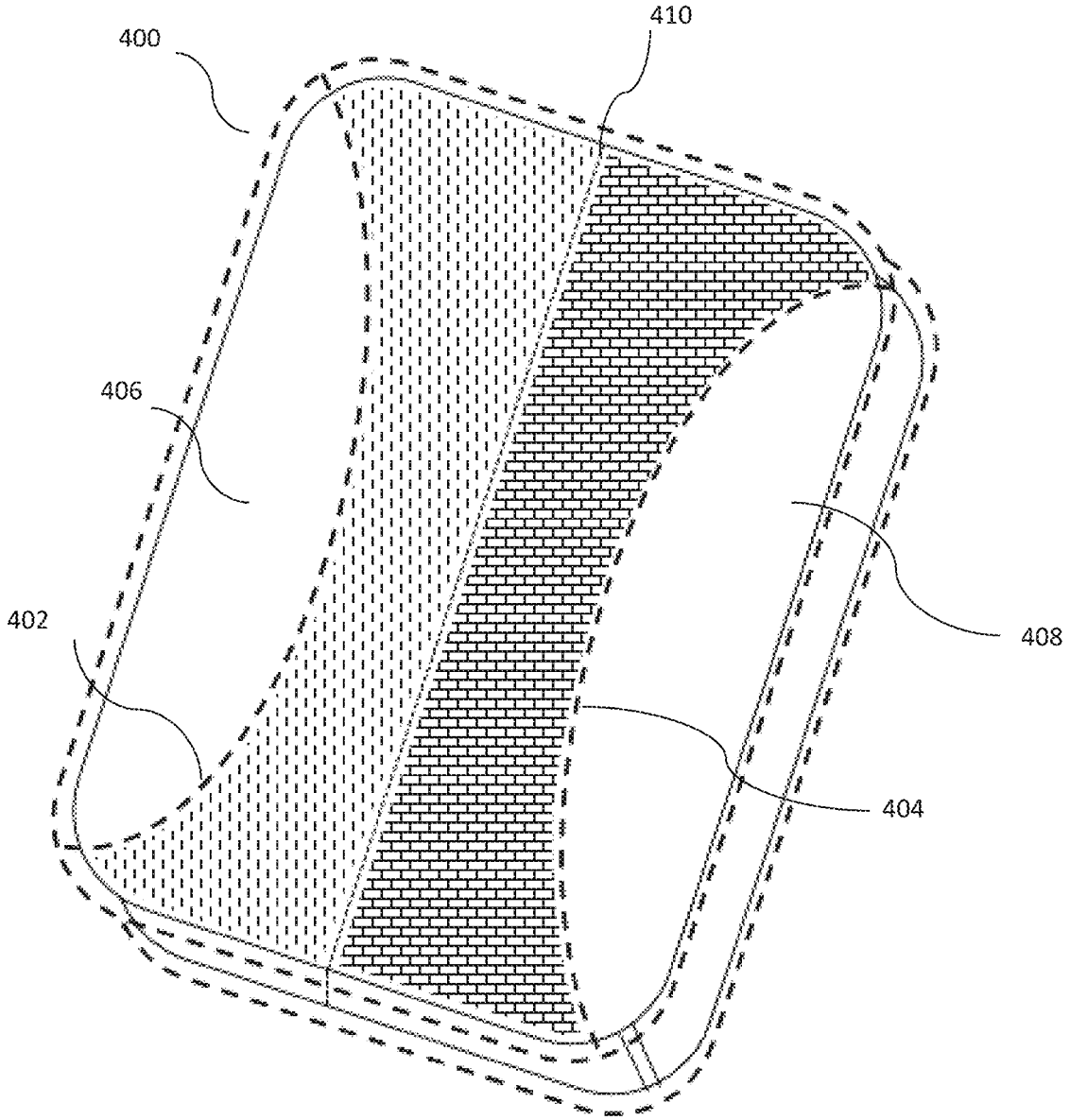
FIG. 4 shows the customizable mattress pad of the invention with two customizable areas where inserts may be placed, with openings positioned along the sides of the mattress.

FIG. 4 shows a customizable mattress pad 400 fitted over and around a mattress, with two pockets 402 and 404. The pockets 402 and 404 have openings along the outer seam of the customizable mattress pad 400. The user can place inserts into the pockets through the slits 406 and 408. As in FIG. 2, a seam 410 keeps the insert in one pocket from shifting into the other pocket. As explained in FIG. 3 above, each insert may be filled with one of several different materials. Once the inserts are in place, the pockets are closed using closure mechanisms, e.g. buttons, zippers, hooks, or Velcro®.

Figure 5:
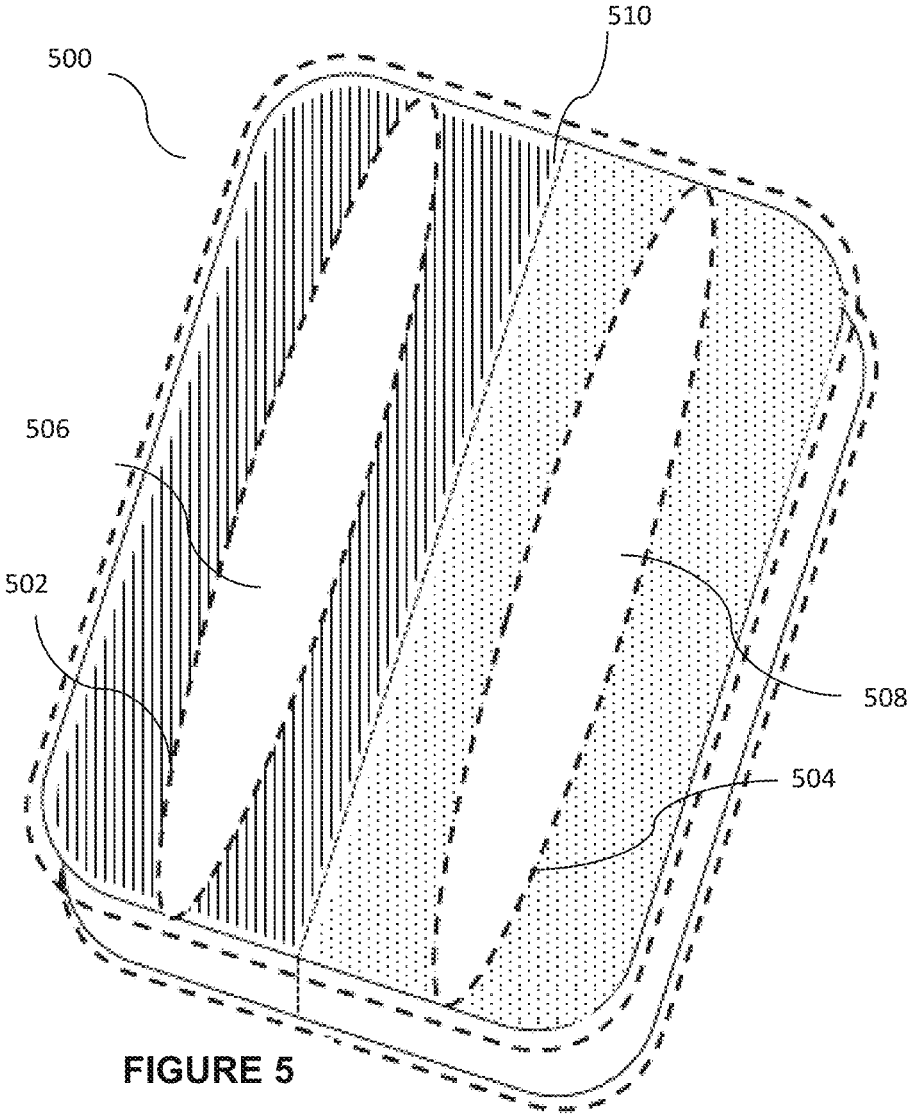
FIG. 5 shows the customizable mattress pad of the invention with two customizable areas where inserts may be placed, with openings down the middle of each area.
Figure 12:
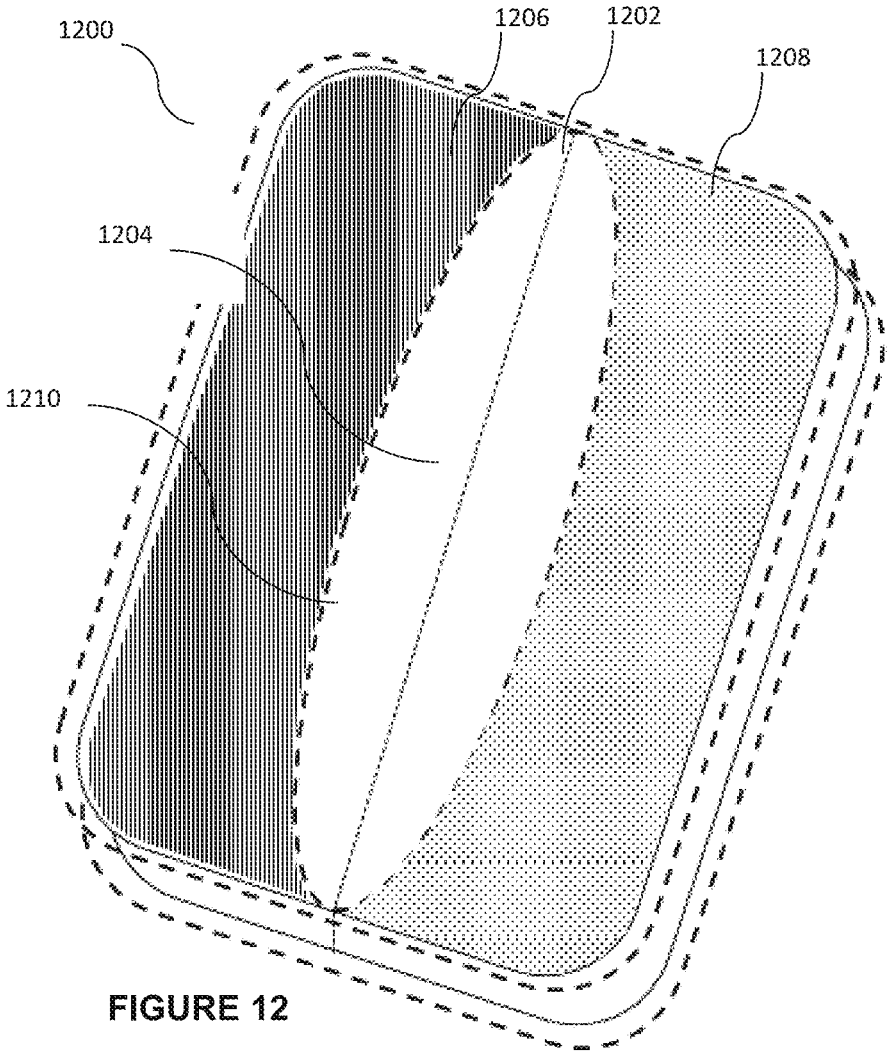
FIG. 12 shows the customizable mattress pad of the invention where inserts are placed into the pad through a slit opening at the center of the mattress pad casing.

FIG. 5 shows yet another embodiment of a customizable mattress pad 500 fitted over and around a mattress, with two pockets 502 and 504. The pockets 502 and 504 have slit openings 506 and 508 in the middle of each pocket. As in FIG. 2, a seam 510 keeps the inserts from shifting from one pocket into the other. As explained in FIG. 3 above, each insert may be filled with one of several different materials. Once the inserts are in place, the pockets are closed using an unobtrusive closure mechanism that will not discomfort the user sleeping on the mattress e.g. flat snap buttons, Velcro®. A similar embodiment in FIG. 12 has a slit opening 1210 along the center of the customizable mattress pad 1200 running parallel and above the seam 1202. Inserts 1206 and 1208 are placed into the pocket 1204 separated by the seam 1202 through the slit opening 1210. As explained in FIG. 3 above, each insert may be filled with one of several different materials.

Figure 6:
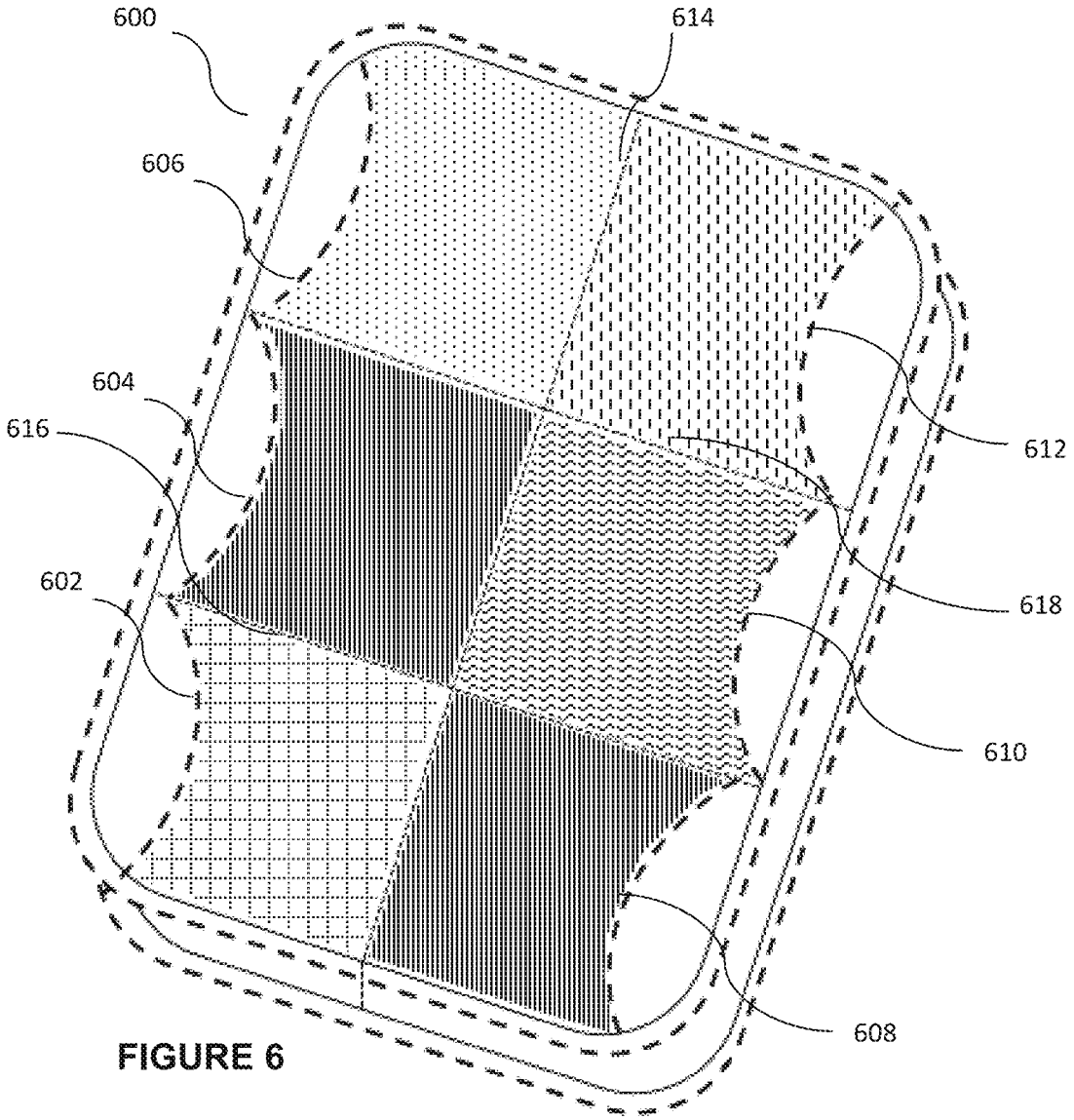
FIG. 6 shows the customizable mattress pad of the invention with six customizable areas alongside one another where inserts may be placed, with openings positioned along the sides of the mattress.

FIG. 6 shows a customizable mattress pad 600 fitted over and around a mattress, with multiple pockets, in this case six pockets 602, 604, 606, 608, 610, 612. A customizable mattress pad 600 may have greater or fewer pockets. The pockets 602, 604, 606, 608, 610, 612 can hold inserts made of an assortment of materials. For instance, a user might want a cooling gel insert near the bottom of the mattress where the feet rest, a supportive firm insert in the area where the spine rests, and a soft insert where the head rests. The user can then insert the cooling gel insert in the lowermost pocket 602, the supportive firm insert in the middle pocket 604, and a soft down feather insert in uppermost pocket 606. The variety of inserts in FIG. 6 are represented through the use of different patterns to allow the user to distinguish between the various inserts, but the inserts may appear the same in practice.

Each of the pockets is isolated by a seam 614 running top to bottom and two seams 616 and 618 running across. The number of seams will vary according to the number of pockets desired. In an embodiment with eight pockets, there will be one seam running top to bottom and three seams running across. Each pocket in FIG. 6 has a slit opening through which the insert is put into place in the customizable mattress pad casing. As explained in FIG. 3 above, each insert may be filled with one of several different materials. The openings to the pockets may be in various locations including, but not limited to, along the center seam running top to bottom. For instance, the opening for one pocket 608 may be moved to the bottom end of the mattress and the opening for another pocket 612 may be moved to the top end of the mattress. Once an insert is in place, it is secured in its position by fixed seams on three sides and temporary closure mechanisms, e.g. buttons, zippers, hooks, Velcro®, on the fourth side.

Figure 7:
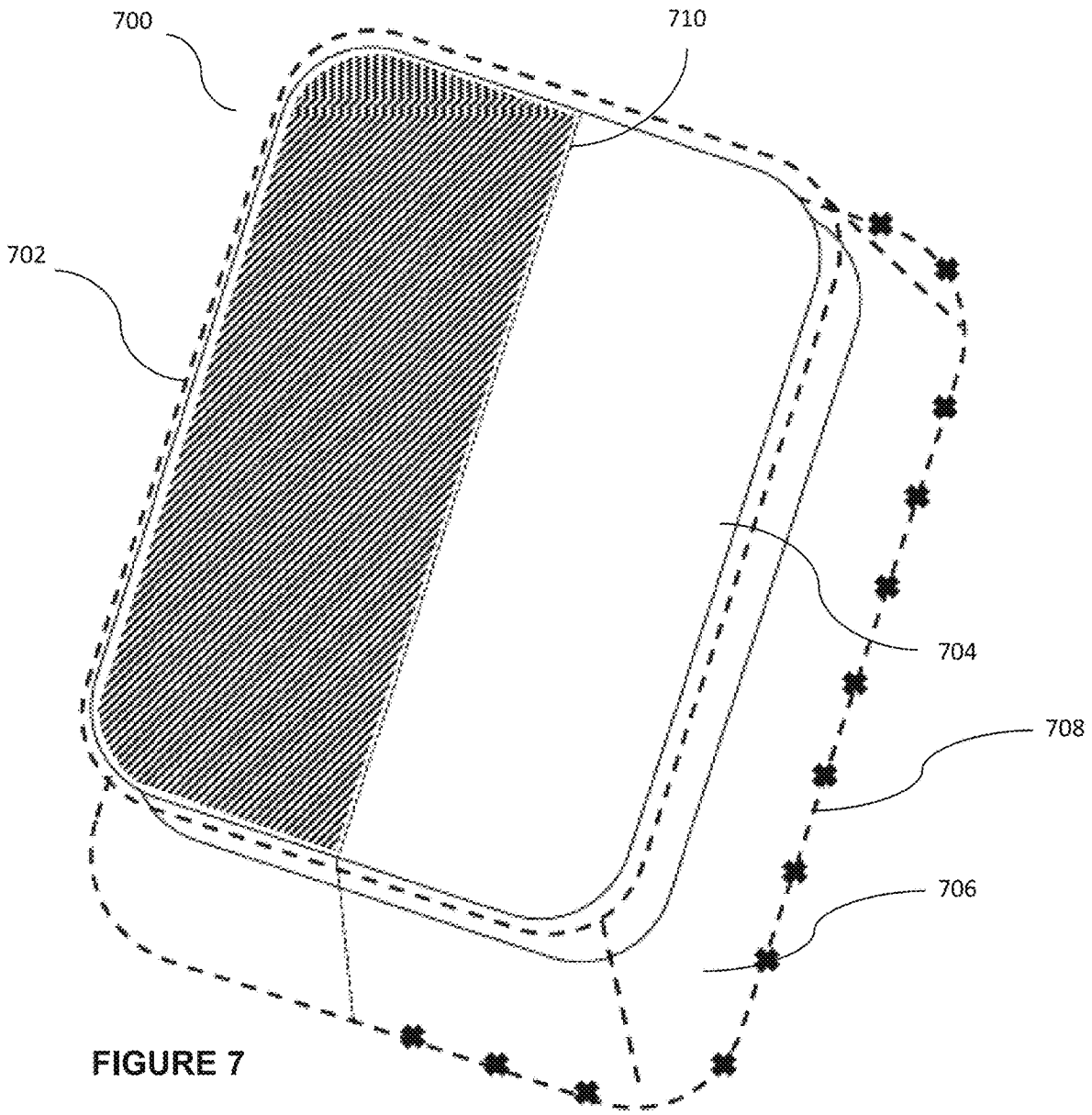
FIG. 7 shows the customizable mattress pad of the invention with two customizable areas and a flap opening encompassing the entire mattress.

FIG. 7 shows a customizable mattress pad casing 700 with two pockets 702 and 704. The customizable mattress pad 700 entirely envelopes the mattress and wraps around the bottom of the mattress. Instead of slit openings through which inserts may be placed within the customizable mattress pad 700, this embodiment features flaps 706 on either side that may be lifted away to place the inserts within the pad 700. As explained in FIG. 3 above, each insert may be filled with one of several different materials. Once the inserts are in place, the flap 706 is brought down and secured to bottom of the customizable mattress pad using a clasping mechanism 708 e.g. snaps, buttons, eyelets, hooks, Velcro®. The portion of the customizable mattress pad 700 around the sides of the mattress may include an elastic material to pull the customizable mattress pad 700 taut around the mattress. The seam 710 is similar to the seam described in FIG. 2 and keeps the insert in one pocket from slipping into the adjacent pocket.

Figure 8:
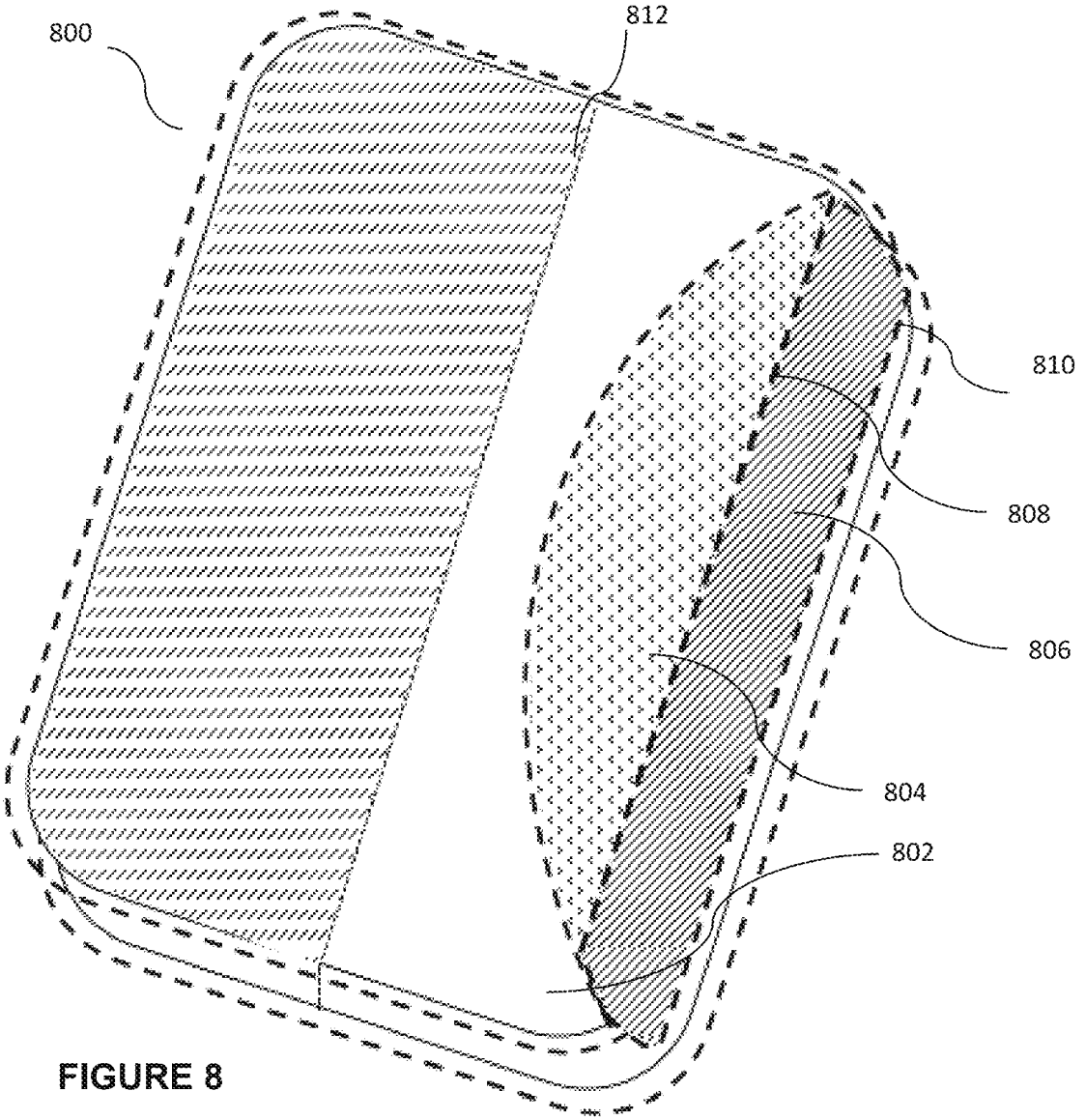
FIG. 8 shows the customizable mattress pad of the invention with two customizable areas and allowing for two or more inserts per area stacked on top of one another.
Figure 10:
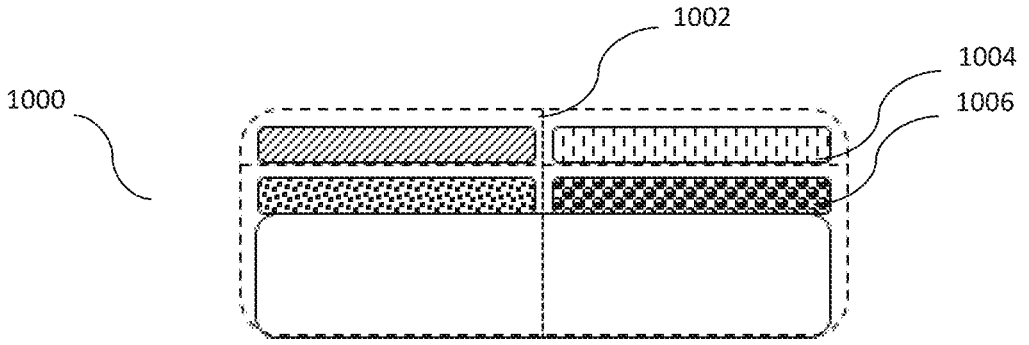
FIG. 10 shows side view of the customizable mattress pad of the invention with two customizable areas and allowing for two or more inserts per area stacked on top of one another.

FIG. 8 shows a customizable mattress pad 800 with a double-insert configuration where each pocket 802 accommodates two or more inserts 804 and 806 stacked on top of each other. While the figure shows only one pocket on the right side of the mattress pad, there may be a corresponding pocket on the left side of the mattress. Further, each side of the mattress pad may have more than one pocket. The insert 804 is shown placed in an upper pocket 808, and the insert 806 is shown placed in a lower pocket 810. This allows the user to place two inserts, for instance, a cooling gel insert and a supportive coir insert, in the same area. As explained in FIG. 3 above, each insert may be filled with one of several different materials. Each pocket has its own closure mechanism e.g. buttons, zippers, hooks, Velcro® to temporarily seal in the insert. The pockets may have openings along sides, the top, or the bottom to allow for the inserts to be placed within the pad. A seam 812 runs down the middle of the customizable mattress pad 800 to keep the inserts from shifting. A similar seam separates the top and bottom layers and is more clearly visible in FIG. 10, which provides a side view of the customizable mattress pad 1000. A seam 1002 separates the left and right inserts and is shown as a seam 812 in FIG. 8. A layer 1004 made of the same material as the customizable mattress pad separates the top and bottom layer inserts shown using different patterns. A similar layer 1006 may also separate the bottom of the pad and the top of the mattress.

Figure 9:
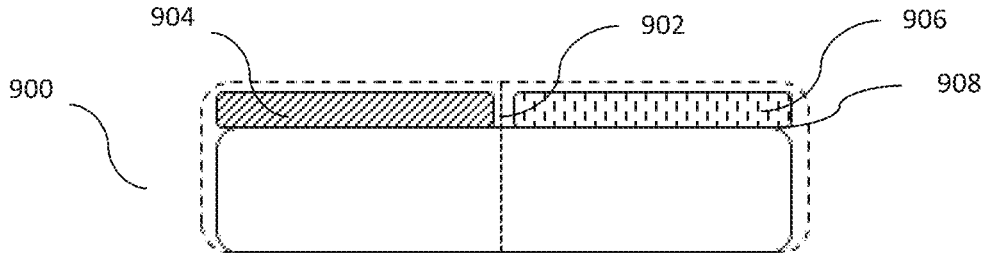
FIG. 9 shows a side view of the invention with two customizable areas.

FIG. 9 shows a side view of the customizable mattress pad 900 with inserts 904 and 906. The inserts 904 and 906 are shown containing different fillings as represented by different patterns. A seam 902 is shown separating the left and right pockets such that the inserts 904 and 906 do not shift from their positions. A layer 908 made of the same material as the customizable mattress pad 900 separates the top and bottom layer inserts.

Figure 11:
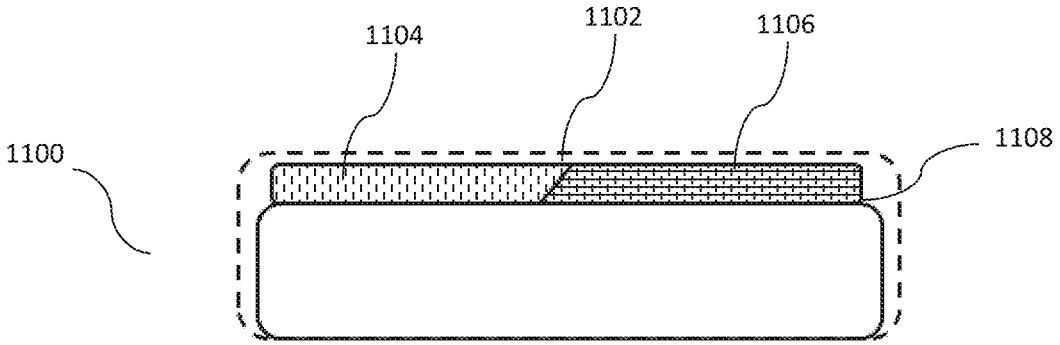
FIG. 11 shows a side view of the customizable mattress pad of the invention with interlocking inserts.

FIG. 11 shows a side view of the customizable mattress pad 1100 with inserts 1104 and 1106. The inserts 1104 and 1106 are shown containing different fillings as represented by different patterns. Instead of a seam, this embodiment has interlocking inserts. The inserts are shaped in a way that they overlap each other along one edge 1102. A layer 1108 made of the same material as the customizable mattress pad 1100 separates the mattress pad inserts from the mattress.

Although the invention is described herein with reference to various embodiments, one skilled in the art will readily appreciate that other applications may be substituted for those set forth herein without departing from the spirit and scope of the present invention. Accordingly, the invention should only be limited by the Claims included below.

The invention claimed is:

1. A modular sleep apparatus, comprising:

a mattress pad casing adapted to be placed over a mattress, the mattress pad casing comprising one or more pockets formed along an outer seam thereof, wherein the one or more pockets include at least two semi-elliptical slits formed along a long edge of the mattress, wherein the at least two semi-elliptical slits are formed in a direction coincident with a direction normal to a top surface of the mattress, wherein the at least two semi-elliptical slits enable insertion of a first insert and a second insert;

the first insert having a first side formed into a first overlapping shape that is slanted, the first insert configured to be placed within at least one pocket of the mattress pad casing; and the second insert having a second side formed into a second overlapping shape that is slanted, wherein the first insert is configured to detachably couple to the second insert by abutting the first overlapping shape that is slanted and the second overlapping shape that is slanted, wherein the abutment of the first overlapping shape that is slanted and the second overlapping shape that is slanted prevents the first insert and the second insert from sliding.

2. The modular sleep apparatus of claim 1, wherein content of the first or second insert comprises any of a natural material; a synthetic material; a firm material; a soft material; a liquid contained within a resilient, leak proof enclosure; a heating material; and a cooling material.

3. The modular sleep apparatus of claim 1, wherein the first and second inserts are inflatable.

4. The modular sleep apparatus of claim 1, wherein the first and second inserts contain a vibrating motor.

5. The modular sleep apparatus of claim 1, further comprising:

the at least one pocket is configured to allow more than one insert to be placed into a same pocket.

6. The modular sleep apparatus of claim 1, further comprising:

a seal for each pocket of the modular sleep apparatus comprising any of snaps, buttons, zippers, hooks, and hook and loop fasteners.

7. The modular sleep apparatus of claim 1, further comprising:

an internal seam within the casing to separate the one or more pockets.

8. The modular sleep apparatus of claim 1, further comprising:

a seam is formed of any of bonded nylon and bonded polyester.

9. The modular sleep apparatus of claim 1, the first insert having a first large side, a second large side, a third small side, and a fourth small side, wherein the first and the second large side have a greater surface area than the third and the fourth small sides, and wherein at least one of the third and the fourth small sides include the first overlapping shape that is slanted.

10. A modular sleep apparatus, comprising:

a mattress comprising at least one pocket formed on a top surface thereof and along an outer seam wherein the at least one pocket includes at least two semi-elliptical slits formed along a long edge of the mattress, wherein the at least two semi-elliptical slits are formed in a direction coincident with a direction normal to a top surface of the mattress, wherein the at least two semi-elliptical slits enable insertion of a first insert and a second insert;

the first insert having a first side formed into a first overlapping shape that is slanted, the first insert configured to be placed within the at least one pocket of the mattress; and the second insert having a second side formed into a second overlapping shape that is slanted wherein the first insert is configured to detachably couple to the second insert by abutting the first overlapping shape that is slanted and the second overlapping shape that is slanted, wherein the abutment of the first overlapping shape that is slanted and the second overlapping shape that is slanted prevents the first insert and the second insert from sliding.

11. The modular sleep apparatus of claim 10, wherein the filling of the first or second insert comprises any of a natural material; a synthetic material; a firm material; a soft material; a liquid contained within a resilient, leak proof enclosure; a heating material; and a cooling material.

12. The modular sleep apparatus of claim 10, wherein the first and second inserts are inflatable.

13. The modular sleep apparatus of claim 10, wherein the first and second inserts contain a vibrating motor.

14. The modular sleep apparatus of claim 10, further comprising:

the at least one pocket is configured to allow more than one insert to be placed into a same pocket.

15. The modular sleep apparatus of claim 10, further comprising:

a seal for each pocket of the modular sleep apparatus comprising any of snaps, buttons, zippers, hooks, and hook and loop fasteners.

16. The modular sleep apparatus of claim 10, further comprising:

an internal seam within the casing to separate one or more pockets associated with the mattress.

17. The modular sleep apparatus of claim 10, further comprising:

a seam is formed of any of bonded nylon and bonded polyester.

18. A method of customizing a mattress, comprising:

placing a mattress pad having at least one pocket over the mattress, wherein the at least one pocket include at least two semi-elliptical slits formed along a long edge of the mattress, wherein the at least two semi-elliptical slits are formed in a direction coincident with a direction normal to a top surface of the mattress, wherein the at least two semi-elliptical slits enable insertion of a first insert and a second insert;

placing the first insert in the at least one pocket, the first insert having a first side formed into a first overlapping shape that is slanted; and placing the second insert having a second side formed into a second overlapping shape that is slanted, wherein the first insert is configured to detachably couple to the second insert by abutting the first overlapping shape that is slanted and the second overlapping shape that is slanted, wherein the abutment of the first overlapping shape that is slanted and the second overlapping shape that is slanted prevents the first insert and the second insert from sliding.

* * * * *